US007356873B2

(12) United States Patent
Nielsen

(10) Patent No.: US 7,356,873 B2
(45) Date of Patent: Apr. 15, 2008

(54) HIGHLY EFFICIENT AUTONOMOUS VACUUM CLEANER

(75) Inventor: Henrik Nielsen, Fontainebleau (FR)

(73) Assignee: Nielsen Innovation, Samois sur Seine (FR)

( * ) Notice: Subject to any disclaimer, the term of this patent is extended or adjusted under 35 U.S.C. 154(b) by 690 days.

(21) Appl. No.: 10/482,827

(22) PCT Filed: Jul. 3, 2002

(86) PCT No.: PCT/FR02/02318

§ 371 (c)(1),
(2), (4) Date: Dec. 31, 2003

(87) PCT Pub. No.: WO03/003896

PCT Pub. Date: Jan. 16, 2003

(65) Prior Publication Data

US 2005/0125937 A1 Jun. 16, 2005

(30) Foreign Application Priority Data

Jul. 3, 2001 (FR) ..... 01 08799

(51) Int. Cl.
*A47L 9/22* (2006.01)
*A47L 5/22* (2006.01)
*A47L 5/28* (2006.01)

(52) U.S. Cl. ..... 15/326; 15/349; 15/412

(58) Field of Classification Search ..... 15/326, 15/349, 350–352, 387, 389, 412, DIG. 1
See application file for complete search history.

(56) References Cited

U.S. PATENT DOCUMENTS 3,126,570 A 3/1964 Green
3,592,566 A 7/1971 Beardslee
3,906,585 A * 9/1975 Mattsson ..... 15/349
4,384,386 A * 5/1983 Dorner et al. ..... 15/377
4,517,705 A * 5/1985 Hug ..... 15/351
4,651,380 A * 3/1987 Ogden ..... 15/321
5,014,388 A * 5/1991 Schiazza et al. ..... 15/339
5,134,752 A 8/1992 Shipman
5,331,715 A 7/1994 Johnson et al.
6,131,239 A * 10/2000 White ..... 15/352
6,282,749 B1 * 9/2001 Tajima et al. ..... 15/387
6,536,073 B2 * 3/2003 Uratani et al. ..... 15/327.4
2002/0121000 A1 * 9/2002 Tyler ..... 15/412

FOREIGN PATENT DOCUMENTS

DE 1010234 6/1957

(Continued)

*Primary Examiner*—David A Redding
(74) *Attorney, Agent, or Firm*—Lucas & Mercanti, LLP

(57) ABSTRACT

The invention provides a vacuum cleaner comprising in particular a structure mounted on transport members (R, R') and carrying an electrically-driven turbine (T) for acting through a filter membrane (M) to establish suction in a collector (S) of particles picked up from the floor and entrained to the collector by a flow of air via a transfer duct (C), characterized in that said turbine (T) comprises a set of blades (P) and a nozzle (1) having a box constituted by an upstream portion (11) in the form of a volute centered on the axis of the blades and a diverging downstream portion (12) into which the upstream portion opens out and that communicates with the outside.

12 Claims, 4 Drawing Sheets

FOREIGN PATENT DOCUMENTS

| | | |
|---|---|---|
| DE | 1013034 | 8/1957 |
| EP | 0289987 | 11/1988 |
| EP | 0453163 | 10/1991 |
| EP | 0648882 | 4/1995 |
| FR | 1299817 | 7/1962 |
| FR | 1572970 | 7/1969 |
| GB | 2311207 | 9/1997 |

* cited by examiner

HIGHLY EFFICIENT AUTONOMOUS VACUUM CLEANER

This application is a 371 of PCT/FR02/02318 filed Jul. 3, 2002.

FIELD OF THE INVENTION

The present invention relates to a vacuum cleaner, and more particularly, a cordless vacuum cleaner providing high cleaning efficiency.

BACKGROUND OF THE INVENTION

Conventional vacuum cleaners generally comprise a structure mounted on transport members and carrying an electrically-driven turbine that acts through a filter membrane to establish suction in a particle collector. The particles are recovered from the floor, e.g. by means of at least one brush, and they are entrained towards the collector by a flow of air via a transfer duct.

However, in order to obtain satisfactory cleaning quality, such turbines require powerful motors (of about 1000 watts (W) to 1500 W) and these are powered from the mains via electric cords.

The efficiency of such motors is not very good and the cords reduce the mobility and the ease of handling of such appliances.

In addition, air flow losses are numerous and large, thus reducing the capacity for recovering heavier particles that the air flow is not capable of transferring all the way up to the collector, thereby degrading the quality of cleaning.

BRIEF SUMMARY OF THE INVENTION

An object of the present invention is to solve these technical problems in satisfactory manner by providing a vacuum cleaner that is cordless, lightweight, and that presents very high cleaning efficiency.

According to the invention, this object is achieved by means of a vacuum cleaner of the above type characterized in that the turbine comprises a set of blades and a nozzle comprising a box constituted by an upstream portion in the form of a volute centered on the axis of the blades and a diverging downstream portion into which the upstream portion opens out and that communicates with the outside, and in that said diverging downstream portion is provided with longitudinal internal partitions for subdividing and slowing down the flow of air.

Preferably, the wall of the box and also the partitions are made of a material that is acoustically insulating and/or absorbs vibration.

According to another characteristic, said diverging downstream portion communicates with the outside via side orifices provided in the wall of the box of the nozzle.

In a variant, the upstream end of said duct is suitable for being connected to a head formed by a roller carrying an outer peripheral brush and internal fins for beating the floor.

In another variant, said head is driven in rotation by an internal motor whose shaft is connected coaxially to the rotary shaft of said roller.

In a first embodiment of the invention, said transfer duct is constituted by a flexible hose removably connected to said head.

Advantageously, the upstream end of said hose is provided with a rigid endpiece serving both to provide a leaktight connection with a spout carried by said head and to provide a handhold for vacuum cleaning without using the head.

Preferably, the hose is also extensible.

In order to enable the vacuum cleaner to be used either as an upright carpet-beating vacuum cleaner or as a canister vacuum cleaner, provision is made for the transport members to be disposed at the bottom portion, and where appropriate at the top portion of the structure. These members are preferably constituted by castor wheels that are optionally motor driven.

In a second embodiment of the invention, said particle transfer duct includes a hinge between a bottom segment and a top segment and enabling said duct to be opened.

Advantageously, said bottom segment of the transfer duct is provided with a box for receiving heavy particles.

According to another characteristic, said structure contains at least one rechargeable electrical battery for powering the turbine and/or rotating the head.

The vacuum cleaner of the invention uses a novel type of turbine having very high efficiency and very low electrical power of the order of 80 W, and it can therefore be powered by rechargeable batteries.

In addition, selective recovery of particles depending on their weight enables air flow losses to be decreased and enables the quality of cleaning to be improved.

BRIEF DESCRIPTION OF THE DRAWINGS

The invention will be better understood on reading the following description given with reference to the drawings, in which.

DETAILED DESCRIPTION OF THE INVENTION

The vacuum cleaner shown in the figures comprises a structure mounted on transport members R and carrying an electrically-driven turbine T for acting via a filter membrane M to establish reduced pressure in a particle collector C. The turbine T is housed in a chamber k and the collector C is constituted in this case by a flexible bag S having an air-permeable wall that is enclosed in a compartment K defined on top and on its side by a leaktight rigid wall and downwards by the membrane M which separates it from the suction chamber k.

Figure 2A:
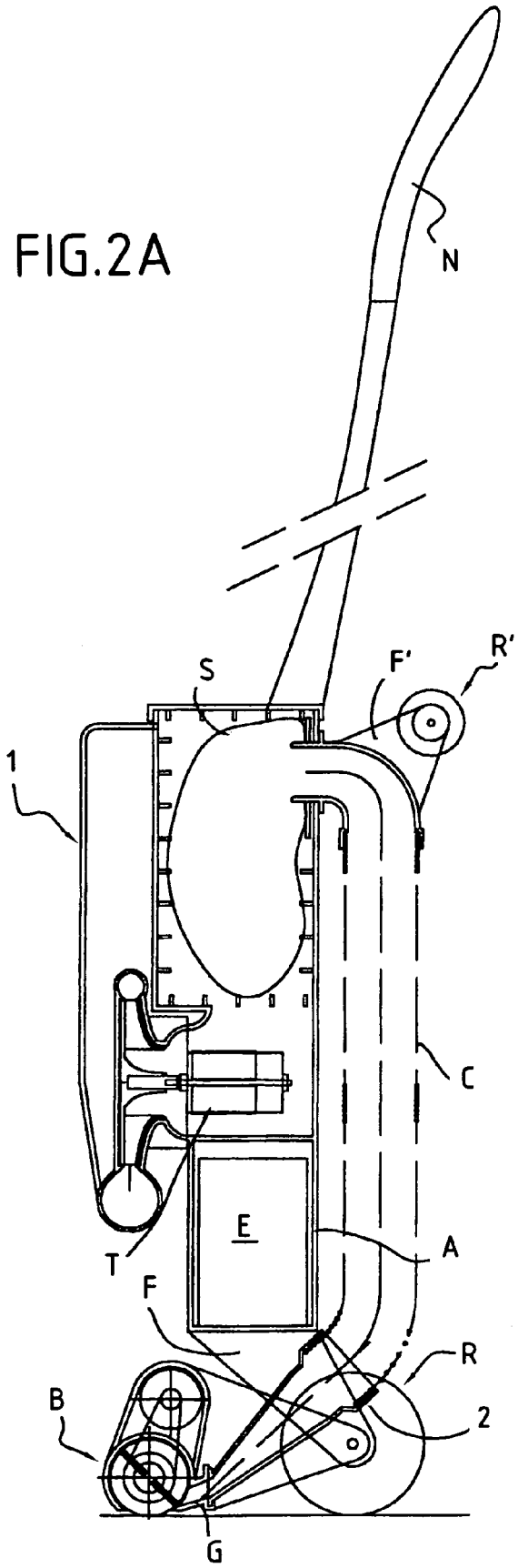
FIGS. 2A, 2B, and 2C are side views in section showing a second embodiment of the vacuum cleaner of the invention in three respective different positions of use.

A variant consists in uniting the membrane and the wall of the bag S, as shown in FIG. 2A.

The bag S is held inside the compartment K by projections D projecting from its inside wall. The particles are picked up from the ground and entrained towards the collector C by a flow of air traveling via a transfer duct C. The flow of air in the duct C is the result of suction produced by the turbine T in the chamber k and the compartment K. The structure is also fitted with a steering and grasping handle N. The turbine T has a set of blades P and a nozzle 1. The nozzle 1 is constituted by a box formed by an upstream portion 11 in the form of a volute centered on the axis of the blades and opening out into a diverging downstream portion 12 communicating with the outside through orifices 10 formed through the sides of the wall of the nozzle box 1.

The diverging downstream portion 12 is provided with longitudinal internal partitions 13 (FIG. 1B) enabling the flow of air delivered by the turbine T to be subdivided and slowed down. The efficiency of such a turbine is thus very high (about 45%) because, due to the partitions 13 and to the steady increase in section of the downstream portion 12, turbulence is not produced and the flow at low speed thus remains laminar.

Figure 1A:
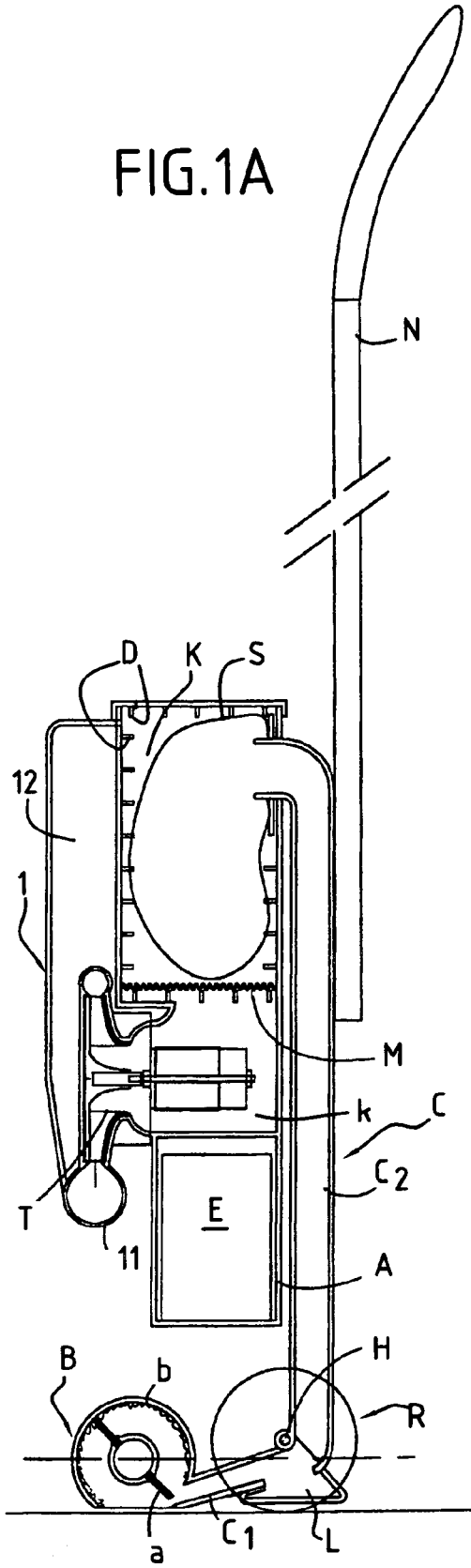
FIGS. 1A and 1B are section views, respectively a side view and a front view, showing a first embodiment of a vacuum cleaner of the invention.
Figure 1B:
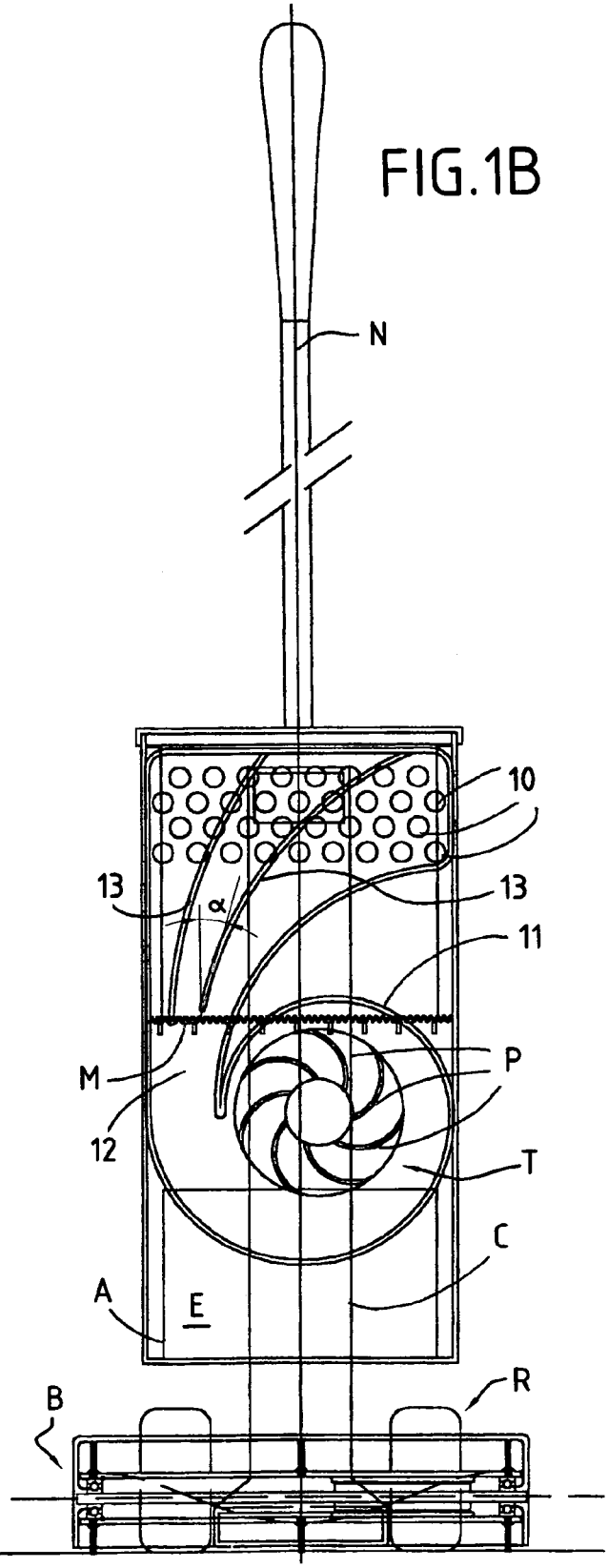

The desired effect is perceptible as soon as the angle $\alpha$ between the vertical and the tangent to the partitions exceeds 5° (FIG. 1B). The vacuum cleaner can be made to be more silent by making the wall of the box and the partitions 13 out of a material that is acoustically insulating and/or that absorbs vibration. The turbine motor is powered by at least one rechargeable battery E received in a casing A disposed beneath the turbine T inside the structure.

The upstream end of the transfer duct C (upstream in the flow direction) is suitable for being connected to a head B enabling particles to be picked up and taken away from the ground.

In the embodiment shown in the figures, the head B is in the form of a roller carrying an outer peripheral brush b and internal fins a for beating purposes.

The head B is mounted in front of the bottom running members R. The head B is driven in rotation either by an internal motor whose shaft is connected, for example, coaxially to the axis of rotation of the roller as in the embodiment of FIGS. 1A and 1B, or else by an external motor with a belt or a gear transmission, as in the embodiment of FIGS. 2A, 2B, and 2C. The first embodiment presents the advantage of being more compact, more robust, and less noisy.

In which case, it is also possible to couple the head motor and the running members.

In the embodiment of FIGS. 1A and 1B, the transfer duct C is rigid and fixed to the structure, including a hinge type connection H defining a bottom segment C1 that slopes a little and a top segment C2 that is substantially vertical.

The hinge H enables the duct to be opened, giving access to a box L for receiving heavy particles, which box is situated at the bottom of the segment C2 beneath the segment C1, thereby enabling said box to be emptied.

This disposition also makes it possible to enlarge the diameter of the duct, thereby reducing air-flow losses.

Figure 2B:
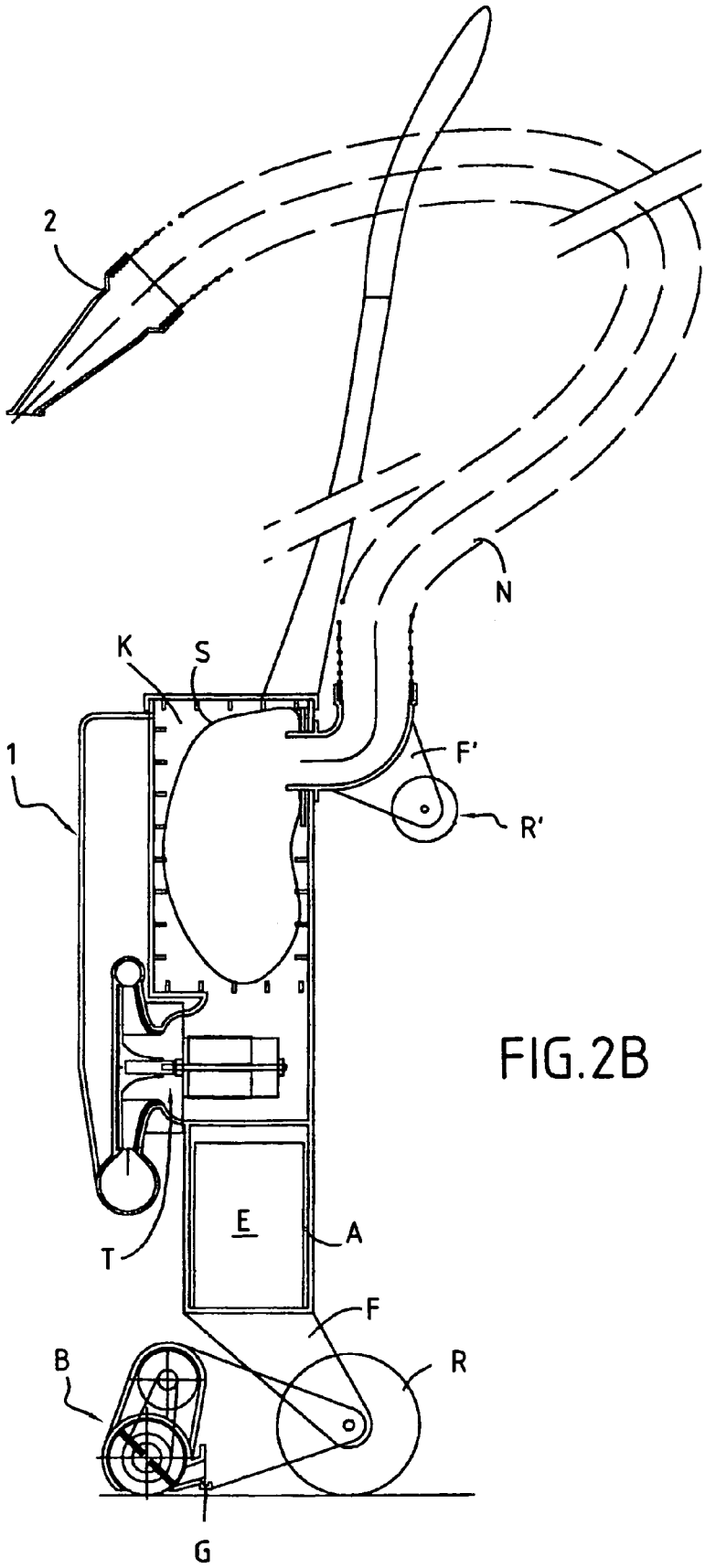
Figure 2C:
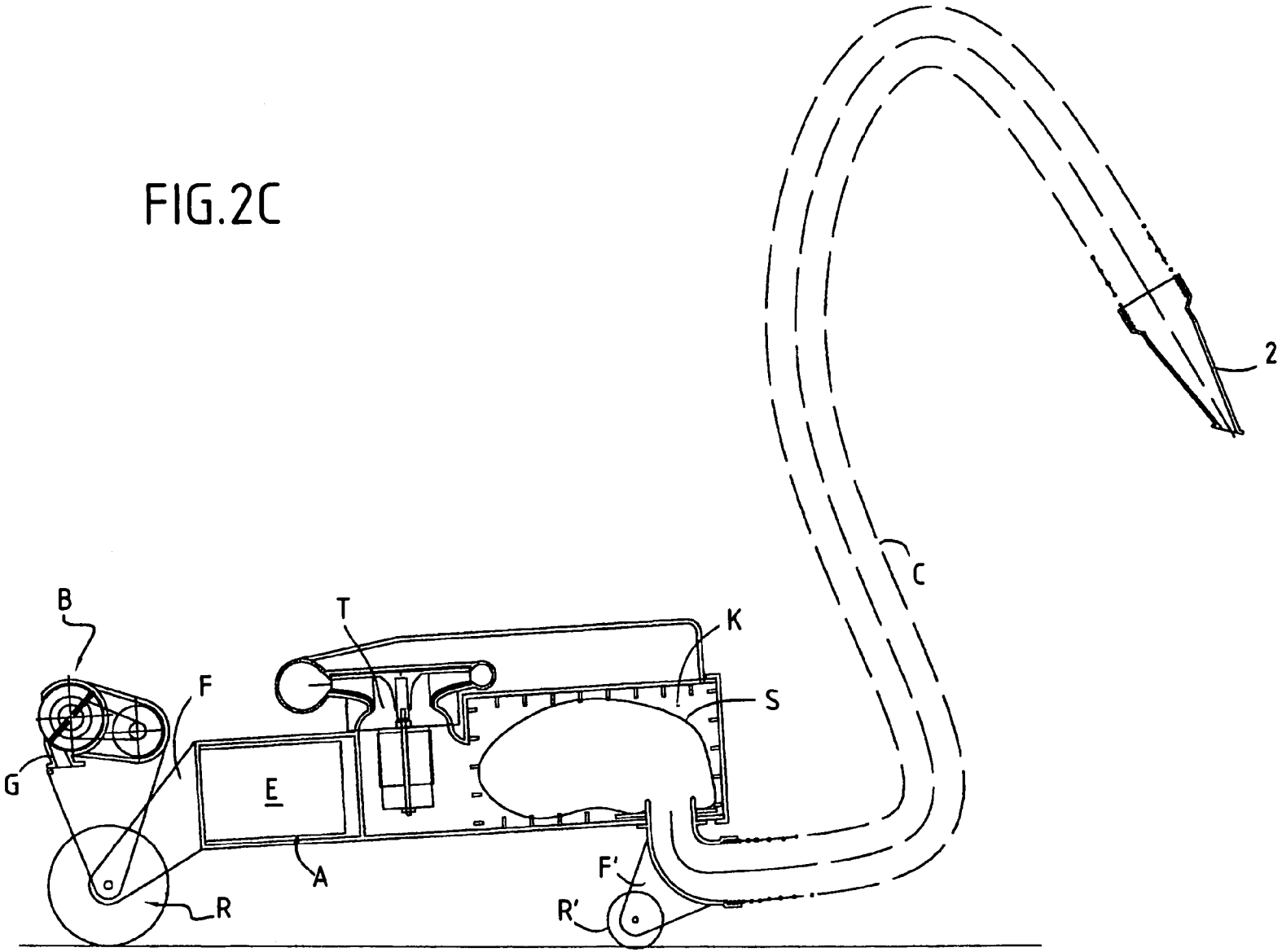

In the embodiment of FIGS. 2A, 2B, and 2C, the transfer duct C is constituted by a flexible hose releasably connected to the head B.

In a variant that is not shown, the hose is also extensible, being made in concertina manner, for example.

The upstream end of the duct C is provided with an endpiece 2 for providing leaktight connection with a spout G carried by the head B. The endpiece 2 also makes it possible to obtain a handhold for vacuum cleaning without using the head, as shown in FIG. 2B.

Still in the embodiment of FIGS. 2A, 2B, and 2C, the structure is provided with two sets of transport members R, R', one of which is mounted near the top of the structure so as to enable the vacuum cleaner to be used as a canister vacuum cleaner as shown in FIG. 2C. Each of the lower and upper sets of transport members R, R' respectively is preferably constituted by a set of castor wheels fixed to the structure by means of forks F, F' and optionally motor driven.

The invention claimed is:

1. A vacuum cleaner comprising a structure mounted on transport members and carrying an electrically-driven turbine for acting through a filter membrane to establish suction in a collector of particles picked up from the floor and entrained to the collector by a flow of air via a transfer duct, wherein said turbine comprises a set of blades and a nozzle comprising:

a box constituted by an upstream portion in the form of a volute centered on the axis of the blades, and a diverging downstream portion into which the upstream portion opens out and that communicates with the outside, wherein said diverging downstream portion is provided with longitudinal internal partitions progressively diverging away from each other, for subdividing and slowing down the flow of air.

2. The vacuum cleaner of claim 1, wherein the wall of the box and the partitions are made of a material that is acoustically insulating and/or absorbs vibration.

3. The vacuum cleaner of claim 1, wherein the said diverging downstream portion communicates with the outside via side orifices provided in the wall of the box of the nozzle.

4. The vacuum cleaner of claim 1, wherein the upstream end of said duct is suitable for being connected to a head formed by a roller carrying an outer peripheral brush and internal fins for beating the floor.

5. The vacuum cleaner of claim 4, wherein said head is driven in rotation by an internal motor whose shaft is connected coaxially to the rotary shaft of said roller.

6. The vacuum cleaner of claim 4, wherein said transfer duct is a flexible hose removably connected to said head.

7. The vacuum cleaner of claim 6, wherein the upstream end of said hose is provided with a rigid endpiece serving both to provide a leaktight connection with a spout carried by said head and to provide a handhold for vacuum cleaning without using the head.

8. The vacuum cleaner of claim 6, wherein the hose is also extensible.

9. The vacuum cleaner of claim 1, wherein said transport members are disposed at the bottom portion, and optionally at the top portion of the structure.

10. The vacuum cleaner of claim 1, wherein said particle transfer duct includes a hinge between a bottom segment and a top segment and enabling said duct to be opened.

11. The vacuum cleaner of claim 9, wherein said bottom segment of the transfer duct is provided with a box for receiving heavy particles.

12. The vacuum cleaner of claim 1, wherein said structure contains at least one rechargeable electrical battery for powering the turbine and/or rotating the head.

* * * * *